US011889957B2

(12) United States Patent
Biesinger

(10) Patent No.: US 11,889,957 B2
(45) Date of Patent: Feb. 6, 2024

(54) BATH ORGANIZER

(71) Applicant: Munchkin, Inc., Van Nuys, CA (US)

(72) Inventor: Quinn Michael Biesinger, Los Angeles, CA (US)

(73) Assignee: MUNCHKIN, INC., Van Nuys, CA (US)

( * ) Notice: Subject to any disclaimer, the term of this patent is extended or adjusted under 35 U.S.C. 154(b) by 0 days.

(21) Appl. No.: 17/578,287

(22) Filed: Jan. 18, 2022

(65) Prior Publication Data

US 2022/0225844 A1 Jul. 21, 2022

Related U.S. Application Data

(60) Provisional application No. 63/138,037, filed on Jan. 15, 2021.

(51) Int. Cl.
*A47K 3/28* (2006.01)
*B65B 67/12* (2006.01)

(52) U.S. Cl.
CPC ..... *A47K 3/281* (2013.01); *B65B 67/1205* (2013.01); *Y10S 206/829* (2013.01)

(58) Field of Classification Search
CPC .... A47K 3/281; A47K 3/001; B65B 67/1205; B65B 67/1238; B65B 67/1227; B65B 67/1216; Y10S 206/829; B65F 1/0013; B65D 33/007; B65D 33/02
See application file for complete search history.

(56) References Cited

U.S. PATENT DOCUMENTS 1,325,143 A * 12/1919 Conterio ..... F16M 13/025 108/42
1,483,640 A * 2/1924 Manning ..... B60J 3/02 296/97.7
3,176,602 A * 4/1965 Wilt ..... B60R 11/04 396/419
3,257,090 A * 6/1966 Frazier ..... B65B 67/1227 53/390
4,919,546 A * 4/1990 Imazeki ..... B65F 1/0006 220/495.11
5,163,645 A * 11/1992 Caruso ..... B65B 67/1227 383/7
5,348,168 A * 9/1994 Emery ..... A47K 3/281 248/206.3
5,513,823 A * 5/1996 Bresnahan ..... B65B 67/1205 403/103
5,657,954 A * 8/1997 Emery ..... A47K 1/09 248/221.12
6,431,386 B1 * 8/2002 Hofman ..... A47K 3/281 220/840
6,517,033 B2 * 2/2003 Russell ..... B65B 67/1227 248/101
D551,006 S * 9/2007 Tau ..... D6/562
7,404,531 B2 * 7/2008 McConnell ..... B65F 1/1415 248/95
7,686,260 B1 * 3/2010 Tetradis ..... A63B 55/60 248/97

(Continued)

*Primary Examiner* — Ko H Chan
(74) *Attorney, Agent, or Firm* — Robert Z. Evora, Esq.

(57) ABSTRACT

A bath organizer having a storage area defined by a left panel, a right panel, a front panel and a bottom panel, and at least one attachment cup installed on a support rail that secures the bath organizer to an attachment surface.

17 Claims, 20 Drawing Sheets

(56) References Cited

U.S. PATENT DOCUMENTS

| | | | | |
|---|---|---|---|---|
| 8,640,890 | B2 * | 2/2014 | Schiller | F16B 47/00 211/85.15 |
| 8,684,323 | B2 * | 4/2014 | McConnell | B65F 1/1415 220/495.1 |
| 8,839,980 | B2 * | 9/2014 | Baines | A47K 3/281 211/90.03 |
| 2013/0161329 | A1 * | 6/2013 | Baines | A47K 3/281 220/476 |

* cited by examiner

BATH ORGANIZER

CROSS REFERENCE TO RELATED APPLICATIONS

This Non-Provisional Utility application claims priority to U.S. Provisional Patent Application Ser. No. 63/138,037, filed Jan. 15, 2021, the contents of which is hereby incorporated by reference herein in its entirety into this disclosure.

TECHNICAL FIELD

The subject disclosure relates generally to water resistant bath organizers adapted to hang securely from the surface of one or more walls and for use in the wet environment common to most bathtubs and showers.

BACKGROUND

Most parents would agree, bath time is significantly easier when it is a fun and enjoyable activity that children consider to be a game. That is why most households with small children possess one or more bath toys for entertaining their kids while bathing. Additionally, many families have other bath time items and tools, such as brushes, sponges, washcloths, cups, towels, and the like, that are optimized for their specific bathing routines. At the same time, it is important to keep the bathing area organized so that other members of the household may use the facilities. Basic containers and baskets for storing these various items in the bathroom can be found in the market. And while some of these containers provide adequate storage capacity, many of these containers take up valuable space in the bathroom and are not adapted for use or installation in the wet environment of the bathtub or shower.

Thus, there is a need for a water-resistant bath organizer that may be effectively installed in the wet bathtub/shower area in order to maximize the cleanliness of the bathroom environment and the efficiency and enjoyment of the bathing routine.

SUMMARY OF THE SUBJECT DISCLOSURE

The present subject disclosure presents a simplified summary of the subject disclosure in order to provide a basic understanding of some aspects thereof. This summary is not an extensive overview of the various embodiments of the subject disclosure. It is intended to neither identify key or critical elements of the subject disclosure nor delineate any scope thereof. The sole purpose of the subject summary is to present some concepts in a simplified form as a prelude to the more detailed description that is presented hereinafter.

While various aspects, features, or advantages of the subject disclosure are illustrated in reference to common bathroom organizers, such aspects and features also may be exploited in various other containers that may benefit from improve cleanliness and water permissive construction and functionality.

To the accomplishment of the foregoing and related ends, the subject disclosure, then, comprises the features hereinafter fully described. The following description and the annexed drawings set forth in detail certain illustrative aspects of one or more embodiments of the disclosure. However, these aspects are indicative of but a few of the various ways in which the principles of the subject disclosure may be employed. Other aspects, advantages and novel features of the subject disclosure will become apparent from the following detailed description of various example embodiments of the subject disclosure when considered in conjunction with the drawings.

In an exemplary embodiment, the present subject disclosure is a bath organizer. The bath organizer includes a storage area delimited by a left panel, a right panel, a front panel and a bottom panel. The bath organizer includes attachment cups for removably securing the bath organizer to an appropriate attachment surface. The attachment cups are removable installed on a support rail disposed in an internal pocket located inside one or more of the panels. The bath organizer is adapted for use in a wet environment and promotes efficient and fun bathing experiences for children and caregivers alike.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Particular embodiments of a bath organizer will now be described in greater detail with reference to the figures.

Figure 1:
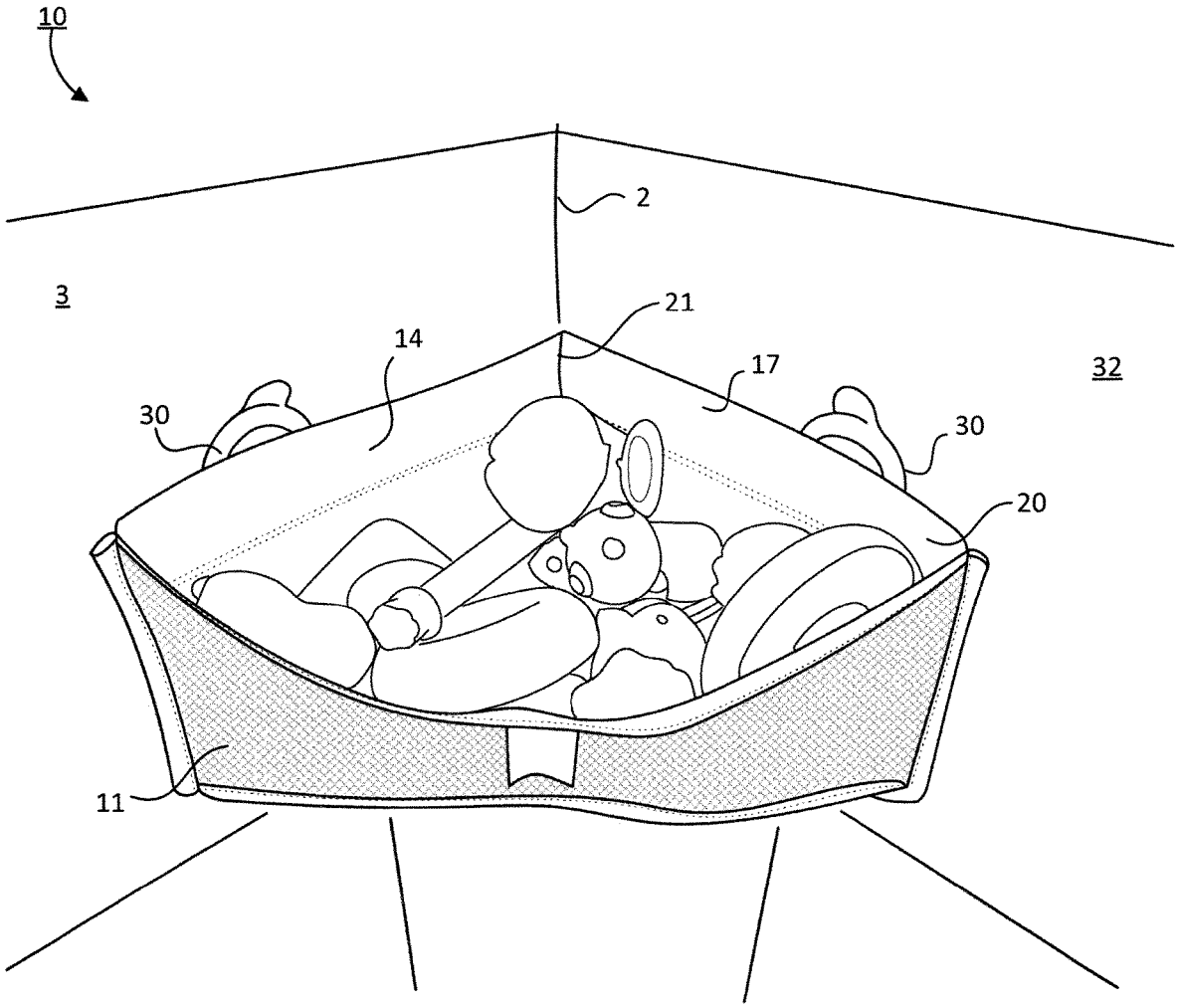
FIG. 1 is a top perspective view of a bath organizer with bath toys and other accessories, according to an exemplary embodiment of the present subject disclosure.

FIG. 1 is a top perspective view of a bath organizer 10 loaded with toys and other bath accessories. The bath organizer 10 may be adapted for installation in a corner junction 2 between two walls 3 or other appropriate attachment surfaces 32. The bath organizer 10 may have a storage compartment 20 formed by a front panel 11, a left panel 14, a right panel 17 and a bottom panel 7 (See FIG. 6). Left and right are defined from the perspective of one facing the front panel 11. The bath organizer 10 may have at least one attachment cup 30 (See FIG. 7) that extends from an opening 24 disposed on an exterior surface 16 of the left panel 14, and/or an exterior surface 19 of the right panel 17. The attachment cup 30 may be installed on a support rail or a support rail assembly 40 that is disposed in an interior pocket 25 located within the left panel 14 and/or with the right panel 17 (See FIGS. 10 and 14-15).

Figure 2:
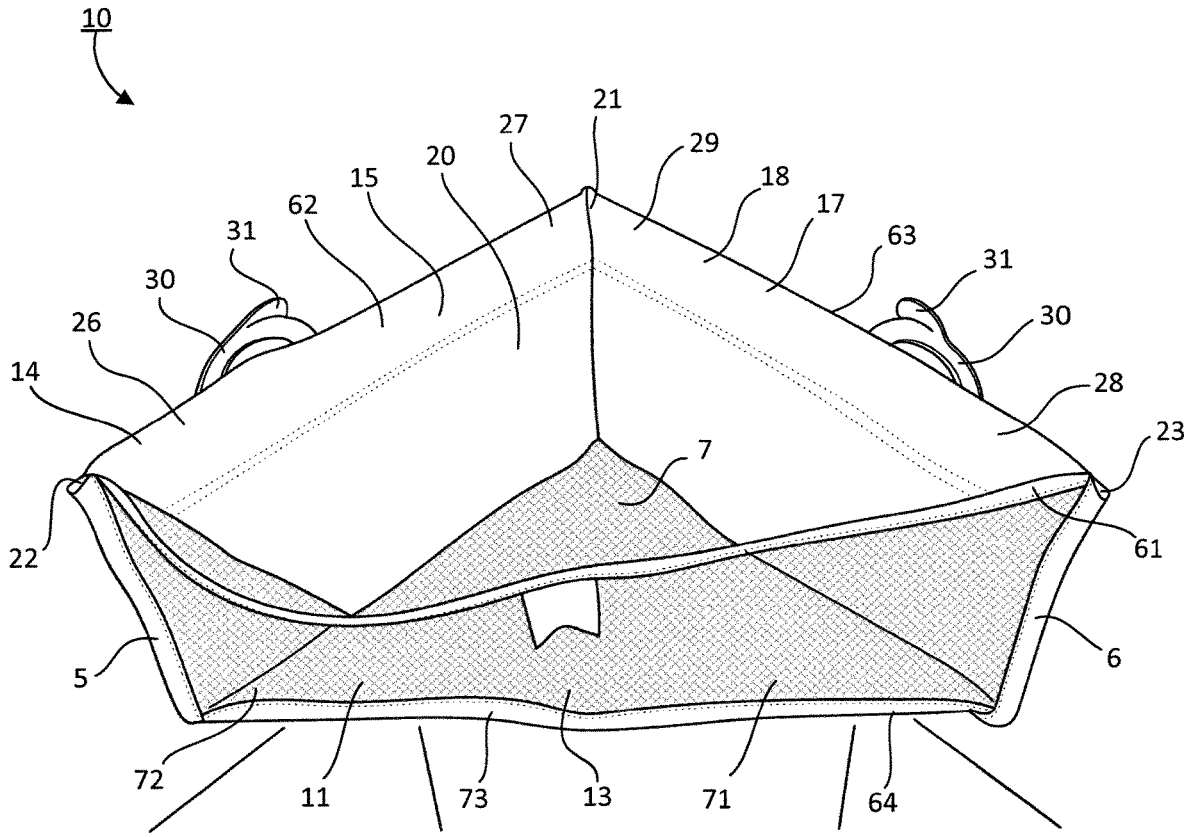
FIG. 2 is a top perspective view of the bath organizer installed in a corner junction of two walls, according to an exemplary embodiment of the present subject disclosure.

FIG. 2 is a top perspective view of the bath organizer 10 installed in the corner junction 2. The bath organizer 10 is substantially triangular in shape. The triangular shape of the bath organizer 10 facilitates the installation of the bath organizer 10 in the corner junction 2 of at least two walls 3. As shown in FIG. 2, the left panel 14 and the right panel 17 may meet and form an apex 21 at a left proximate portion 27 of the left panel 14 and a right proximate portion 29 of the right panel 17. The apex 21 may have a substantially 90-degree angle between the left and right panels 14, 17. The right angle, or substantially right angle, formed between the left and right panels 14, 17 allows the bath organizer 10 to fit snugly in common corner junctions 2 found in many homes. Such corner junctions 2 are generally located in every room of a house including, bathrooms, kitchens, bedrooms, garages, patios, living rooms, and the like. Corner junctions 2 may also be found in common household structures such as showers, closets, cabinets, closets, sinks, and/or where various pieces of furniture abut against another surface forming the corner junction 2 with a substantially right angle. As shown in FIGS. 1-6, the bath organizer 10 is installed in the corner junction 2 formed by two walls 3 in a shower.

As shown in FIG. 2, a left vertex 22 may be disposed at the point where a left distal portion 26 of the left panel 14 meets the front panel 11. A right vertex 23 may be disposed at a point where a right distal portion 28 of the right panel 17 meets the front panel 11. As shown in FIG. 2, the front panel 11 and bottom panel 7 may be formed of a mesh 71 or netting material. The mesh 71 may consist of a network of fibers or threads woven or attached together such that numerous small mesh apertures 72 are formed therein. The mesh apertures 72 enable liquid to drain from within the storage compartment 20. The mesh apertures 72 allow air to circulate into the storage compartment 20 in order to promote drying and freshness. The left and right panels 14, 17 may be formed from an elastic material such as neoprene, a water-resistant or water-proof textile, silicone, or the like. The front panel 11 may be fastened to the left and right panels 14, 17 by seam, stiches, zipper, snap fit, magnetic attachment, hook and loop, and/or any other similar attachment means.

Figure 6:
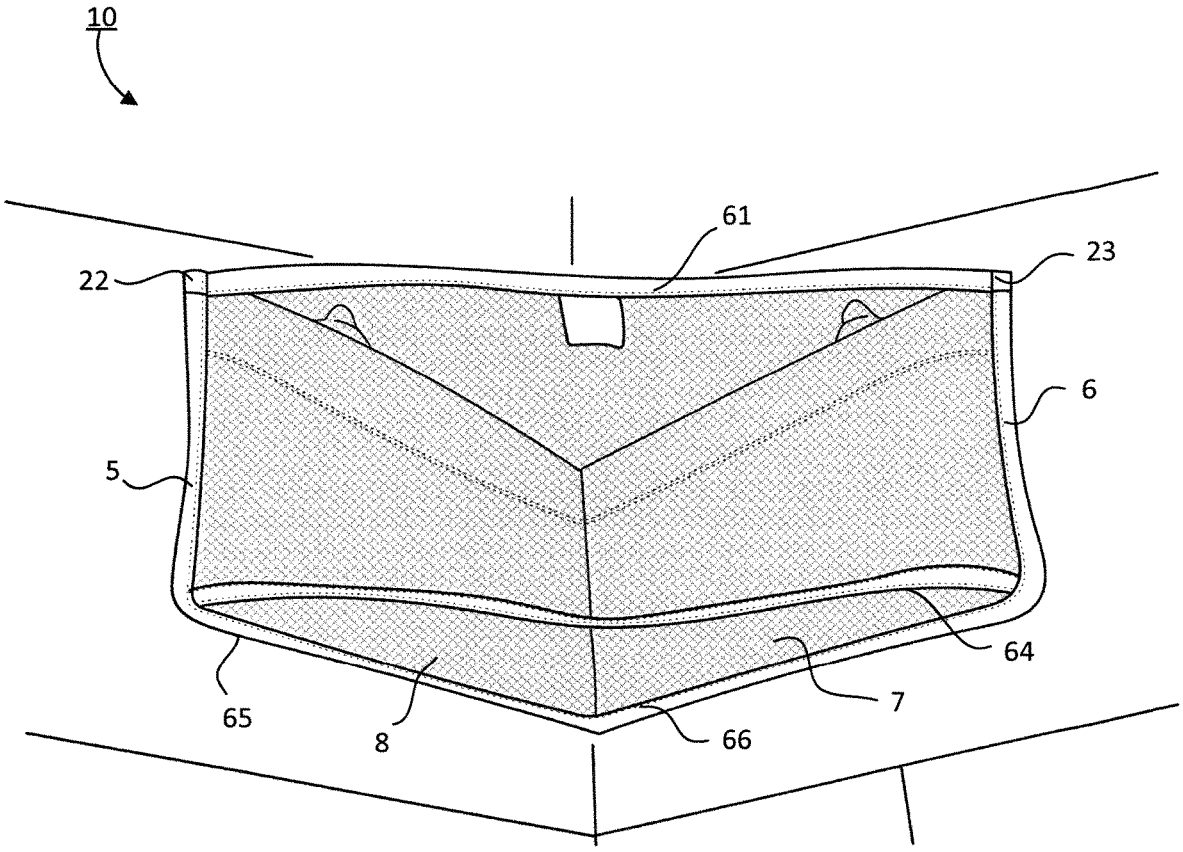
FIG. 6 is an upward facing front perspective view of the bath organizer, according to an exemplary embodiment of the present subject disclosure.

As shown in FIG. 1-6, the front panel 11 is attached to the left and right panels 14, 17, at the left and right vertices 22, 23, respectively, through a seam or reinforced seam 73. Reinforced seams 73 are formed where the mesh 71 of the front panel 11 is sewn into a front left edge 5 disposed at the left distal portion 26 of the left panel 14, and where the mesh of the front panel 11 is sewn into a front right edge 6 disposed at the right distal portion 28 of the right panel 17. Reinforced seams 73 are also formed at a top edge 61 of the front panel 11 and a bottom edge 64 of the front panel 11. The bottom edge 64 joins the bottom panel 7 to the front panel 11. The top edge 61 and bottom edge 64 of the front panel 11 connect between the front left edge 5 and the front right edge 6 to provide strength and rigidity to the front panel 11. The interior volume between the panels 7,11, 14, 17 collectively form the area of the storage compartment 20. Reinforced seams 73 may also be formed at a back left edge 65 that connects the left panel 14 to the bottom panel 7, and at a back right edge 66 that connects the right panel 17 to the bottom panel 7 (See. FIG. 6). The reinforced seams 73 of the bath organizer 10 help to provide structure to the overall shape of the bath organizer 10 and securely connect the panels 7, 11, 14, 17.

Figure 3:
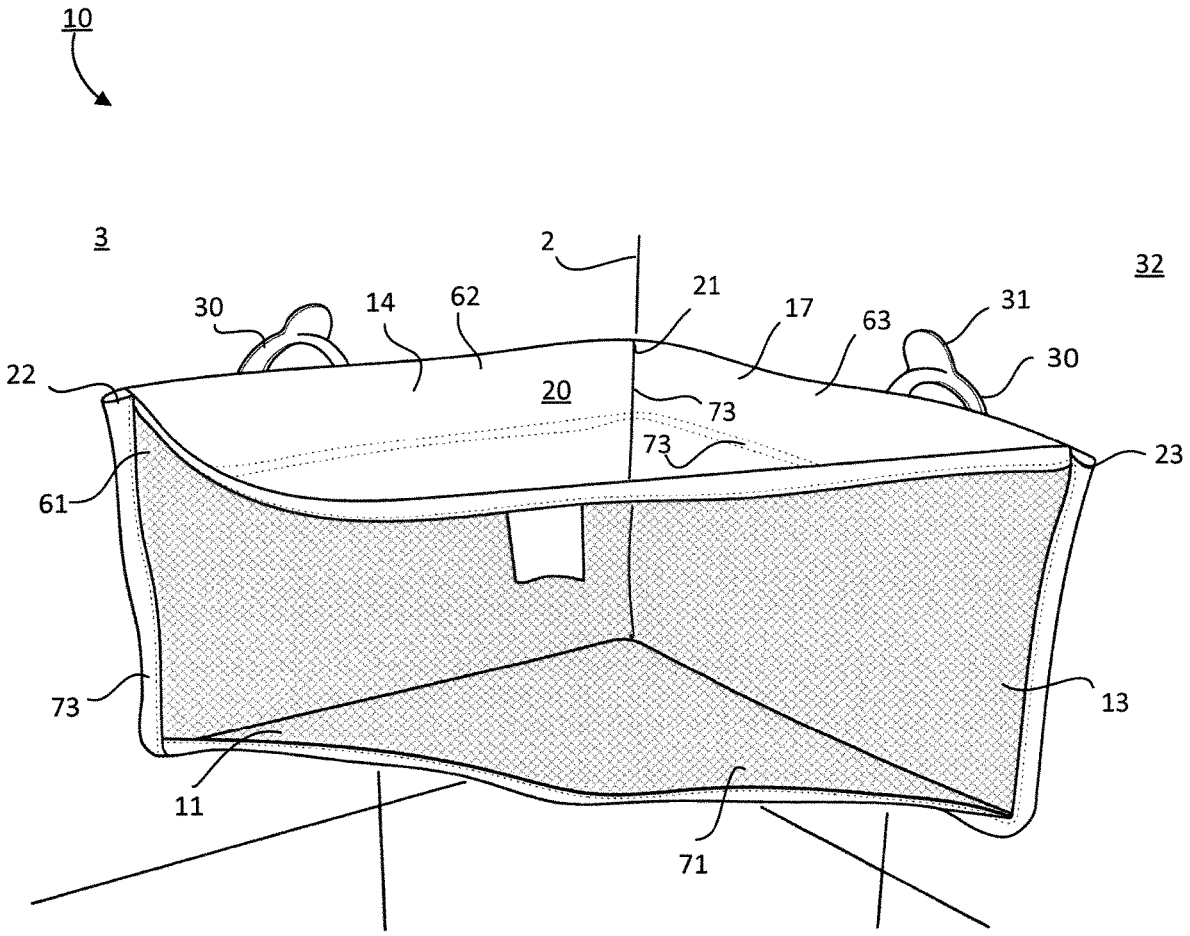
FIG. 3 is a front perspective view of the bath organizer, according to an exemplary embodiment of the present subject disclosure.
Figure 4:
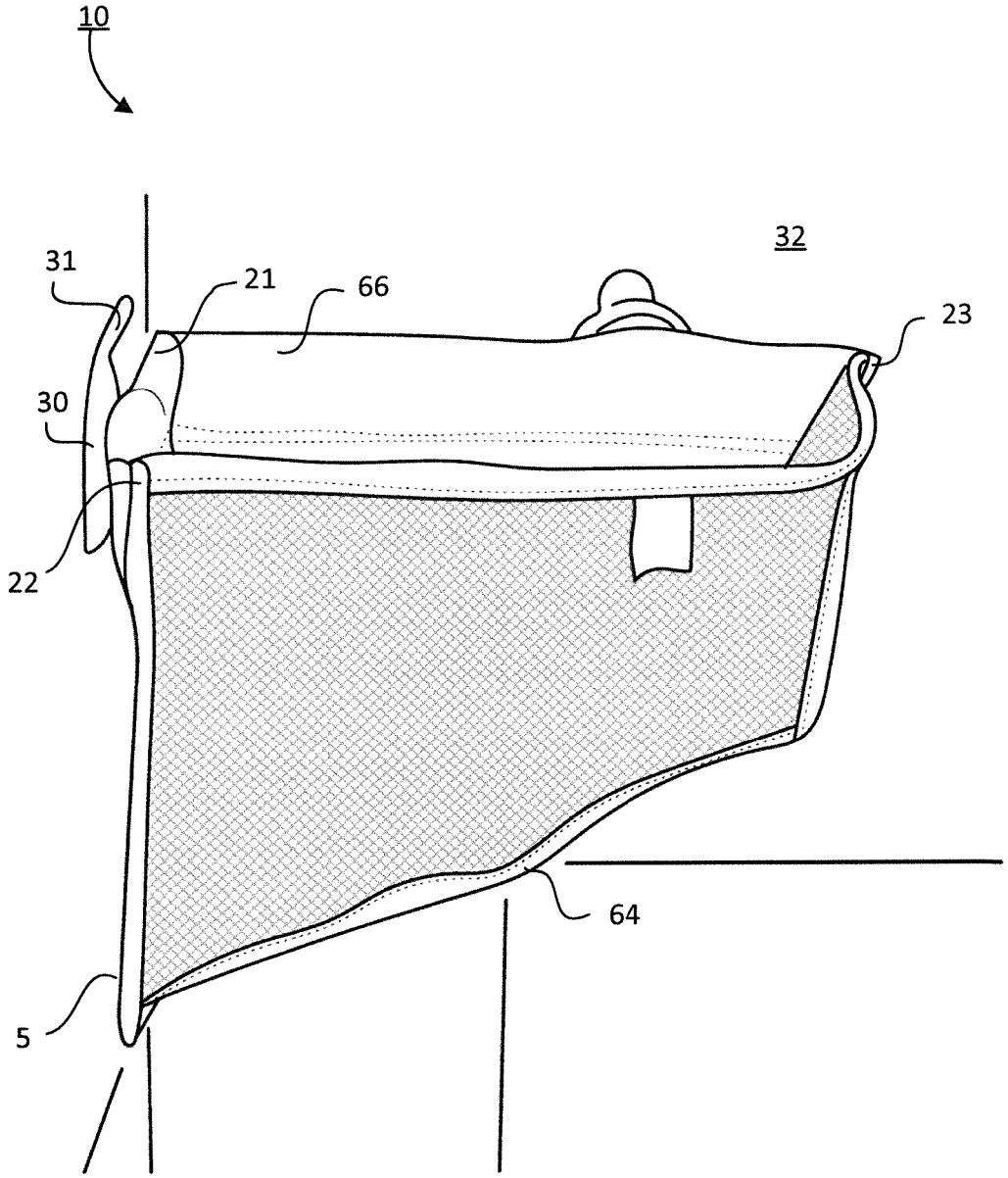
FIG. 4 is a side view of the bath organizer, according to an exemplary embodiment of the present subject disclosure.
Figure 5:
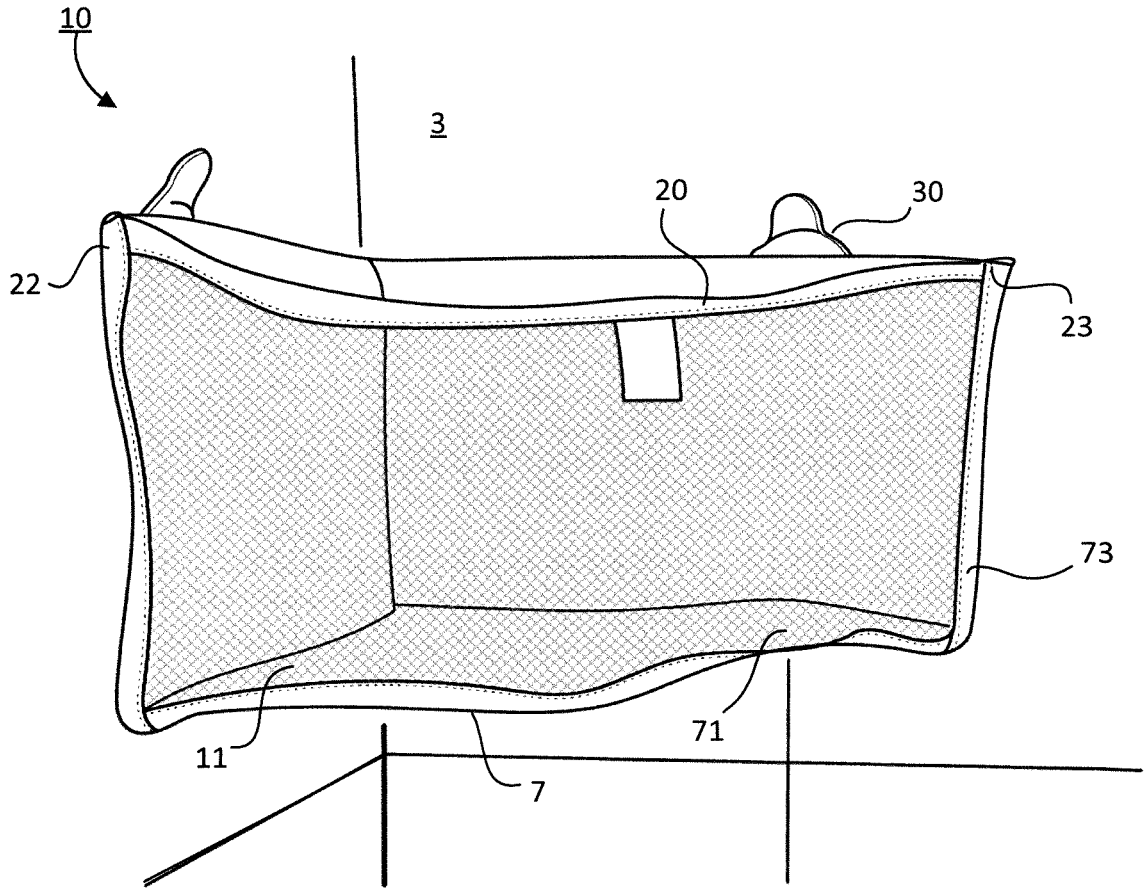
FIG. 5 is a side perspective view of the bath organizer, according to an exemplary embodiment of the present subject disclosure.

As shown in FIGS. 2-3, the bath organizer 10 is substantially triangular is shape when traced along a top left edge 62 disposed on the top of the left panel 14 and a top right edge 63 disposed on the top of the right panel 17 and the top front edge 61 disposed on the top of the front panel 11. The shape of the bottom panel 7 is the translated image (extended through the vertical plane without rotation) of the shaped formed when tracing the top edges 61, 62, 63 of the bath organizer 10. When extended along the vertical plane defined by the front left and right edges 5,6, the substantially triangular shape of the bath organizer 10 forms a triangular prism. In geometry, a prism is a polyhedron having an n-sided polygonal base, a second base that is a translated copy of the first base, and n other faces that are parallelograms joining the corresponding sides of the two bases. As shown in FIGS. 1-6, the bottom panel 7 is triangular in shape (specifically a right triangle) with internal angles of 90 degrees at the apex 21 and 45 degrees at both the left vertex 22 and the right vertex 23. The right triangle shape of the bottom panel 7 is the translated shape of the triangle defined by the top edges 61, 62, 63 of the bath organizer 10.

While the bath organizer 10 is shown as substantially a triangular prism, additional panels may be formed in the bath organizer 10 to form different polyhedron shapes. For example, a fifth panel may be added to the left panel 14, the right panel 17, front panel 11 and bottom panel 7 in order to form a rectangular or square shaped storage compartment 20. When translated through the vertical plane, the bath organizer 10 would then have a cuboid or cubic shape overall. A sixth panel may be added to the bath organizer to form a pentagon shaped storage compartment 20, and a pentagonal prism shape overall. A seventh panel may be added to the bath organizer 10 to form a hexagon shaped storage compartment 20 and a hexagonal prism shape overall. It is further contemplated that a top panel (not shown) may be provided with the bath organizer 10 in order to cover the storage compartment 20, or that further interior panels (not shown) may be installed within the storage compartment 20 to form separate storage spaces therein. Interior panels are adapted to fold when the bath organizer 10 is in a folded storage position (FIG. 9).

Additional storage compartments 20 may be disposed under the bath organizer 10 in multi-tier or stacked configuration. For example, the bath organizer 10 may have a top storage compartment, a middle storage compartment, and a bottom storage compartment connected by panels extending vertically from the left panel 14 and the right panel 17. The multi-tier bath organizer 10 may have additional attachment cups 30 disposed on each or any level in order to secure the bath organizer 10 to the attachment surfaces 32.

Figure 7:
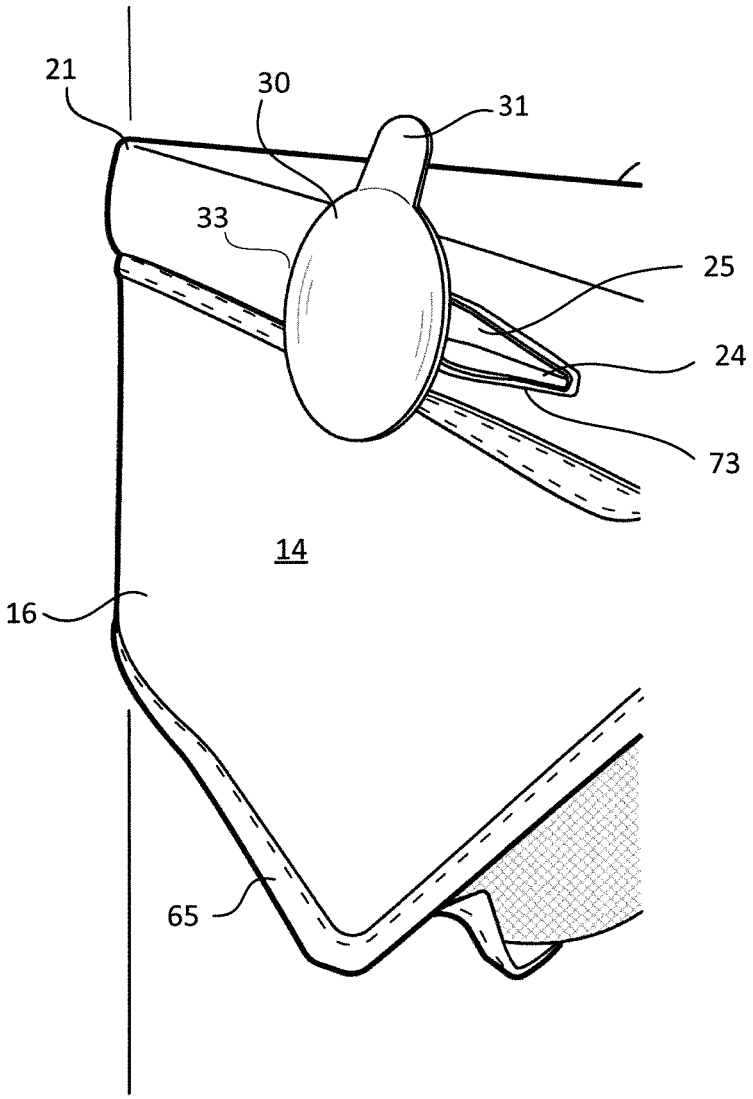
FIG. 7 is a side view of the bath organizer, according to an exemplary embodiment of the present subject disclosure.
Figure 8:
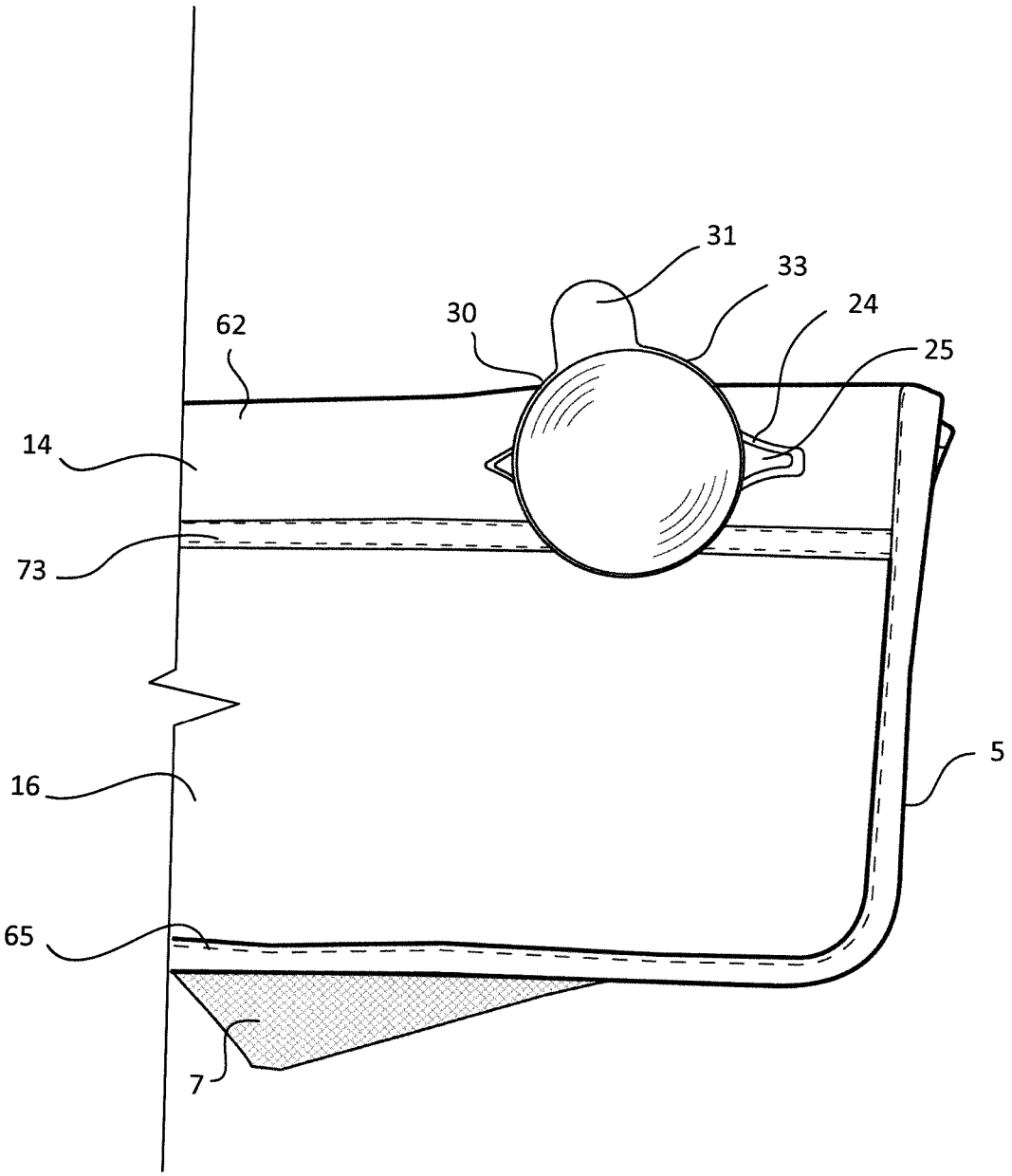
FIG. 8 is a rear perspective view of the bath organizer, according to an exemplary embodiment of the present subject disclosure.

The bath organizer 10 may have at least one attachment cup 30 disposed on the left panel 14 and/or the right panel 17. As shown in FIGS. 7-8, the attachment cup 30 may be substantially circular in shape, however, the attachment cup 30 may be any shape such as: rectangular, triangular, elliptical, amorphous, and/or the like for securing the bath organizer 10 to the attachment surface 32. A tab 31 may be disposed on the attachment cup 30 in order to pull the attachment cup 30 from the attachment surface 32. The attachment surface 32 may be the wall 3, the corner junction 2 formed between two surfaces, or any other suitable surface for attaching the bath organizer 10. The attachment cup 30 may be formed from an elastic material such as plastic, rubber, synthetic elastomers and/or the like, in order to create an adhesion force between the attachment cup 30 and the attachment surface 32. As shown in FIGS. 7-8, the attachment cup 30 is adapted to cause a suction force between the attachment cup 30 and the attachment surface 32. Alternatively, the attachment cup 30 may utilize a traditional adhesive or a magnetic force, electrostatic force, pressure sensitive adhesive, mechanical bonding force and/or the like in order to adhere the attachment cup 30 to the attachment surface 32.

Figure 9:
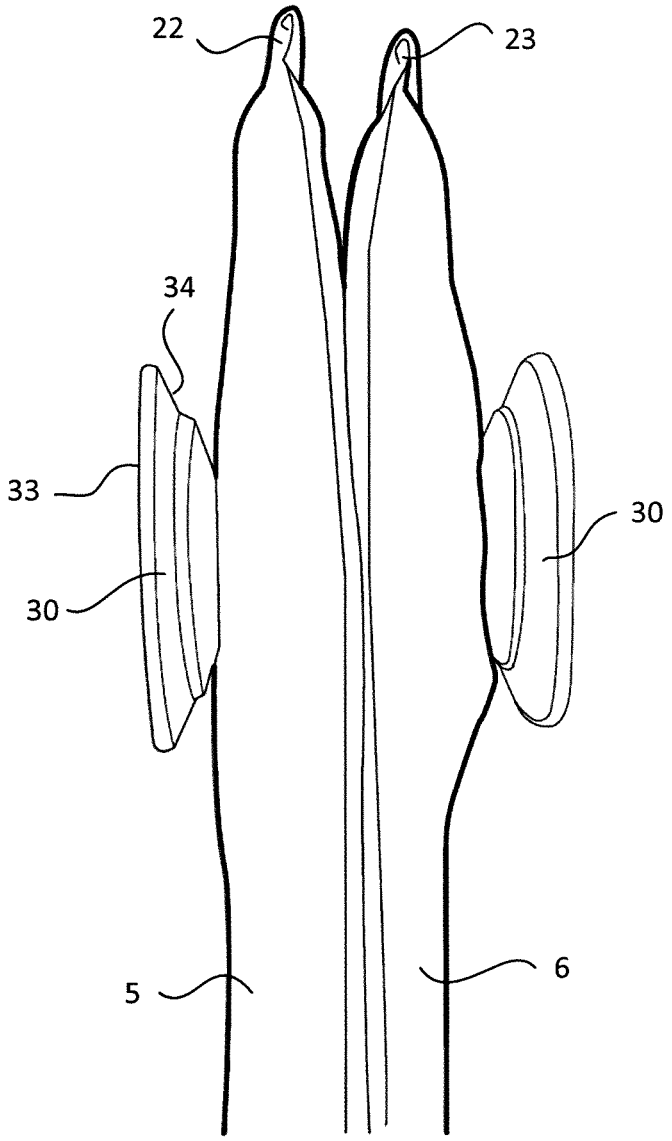
FIG. 9 is a front view of the bath organizer in a folded configuration, according to an exemplary embodiment of the present subject disclosure.

As shown in FIGS. 7-9, an inner portion 33 of the attachment cup 30 may have a concave curve in order to create a suction force when pressed against an attachment surface 32. Accordingly, an outer portion 34 of the attachment cup 30 may have an overall convex curve that is complementary to the shape of the inner portion 33. The attachment cup 30 may be designed with at least one aperture (not shown) in order to receive a nail, screw, pin, and/or the like in order to secure the bath organizer 10 to an appropriate surface 32. The attachment cup 30 may fit into a complementary slot of an attachment bracket (not shown) that may be more permanently affixed to the attachment surface 32. The attachment cup 30 may also be adapted to hang the bath organizer 10 from a hook, line, or pole.

Figure 12:
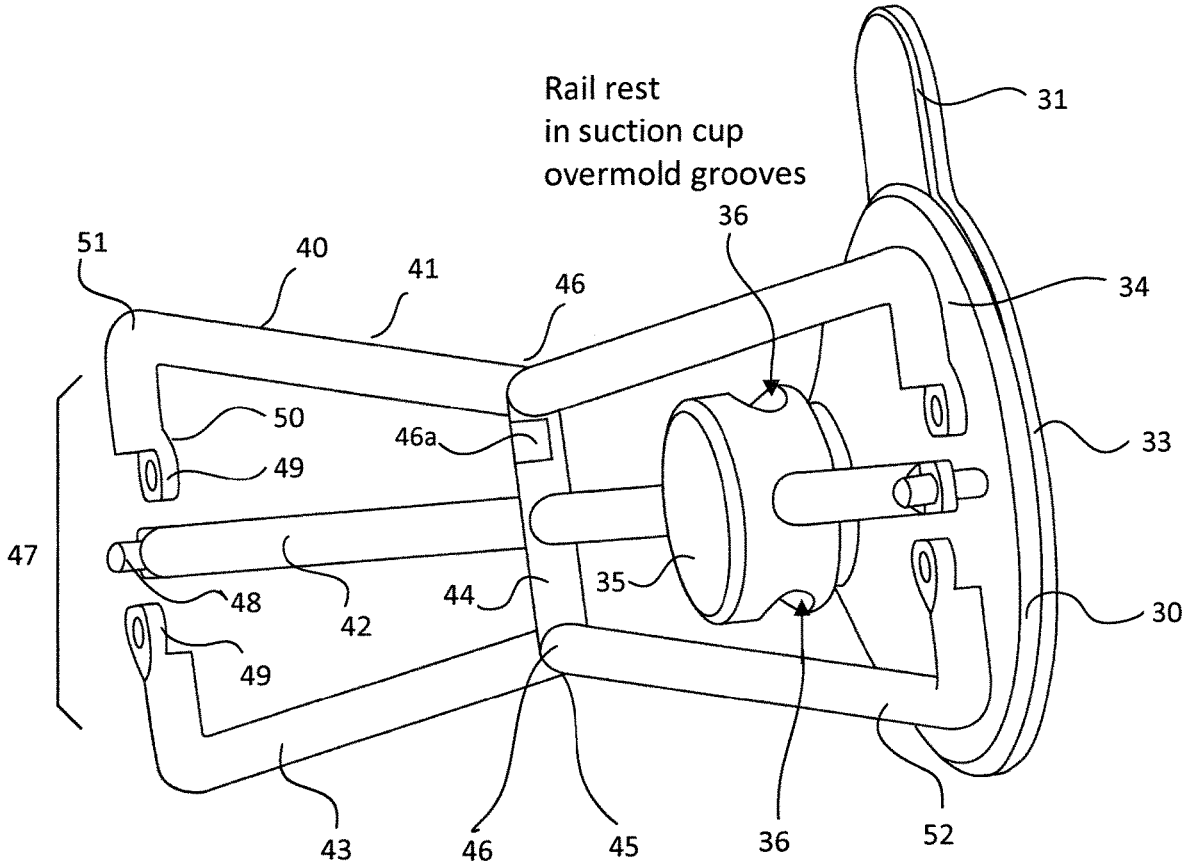
FIG. 12 is a front perspective view of the attachment cup installed on the support rail in an open position, according to an exemplary embodiment of the present subject disclosure.

As shown in FIG. 9, the bath organizer 10 may fold for convenient storage in a substantially flat configuration. In the folded position, the left vertex 22 is brought together with the right vertex 23 such that the front left edge 5 and front right edge 6 are touching. In this substantially flat position, the bath organizer 10 may be stacked with other items or stored conveniently. The bath organizer 10 may have a single support rail 40 extending from the left panel 14 through the apex 23 to the right panel 17 that is capable of folding (See. FIG. 12). Alternatively, the bath organizer 10 may have more than one support rail 40 that does not extend through the apex 23. For example, a first support rail 40 may be disposed in the left panel 14 and a second support rail 40 may be disposed in the right panel 17, with neither support rail extending through the apex 23. This configuration still allows the bath organizer 10 to fold flat and may offer additional benefits such as simpler support rail 40 design and manufacturing. Multiple, distinct, support rails 40 may be disposed in any panel of the bath organizer 10.

Figure 10:
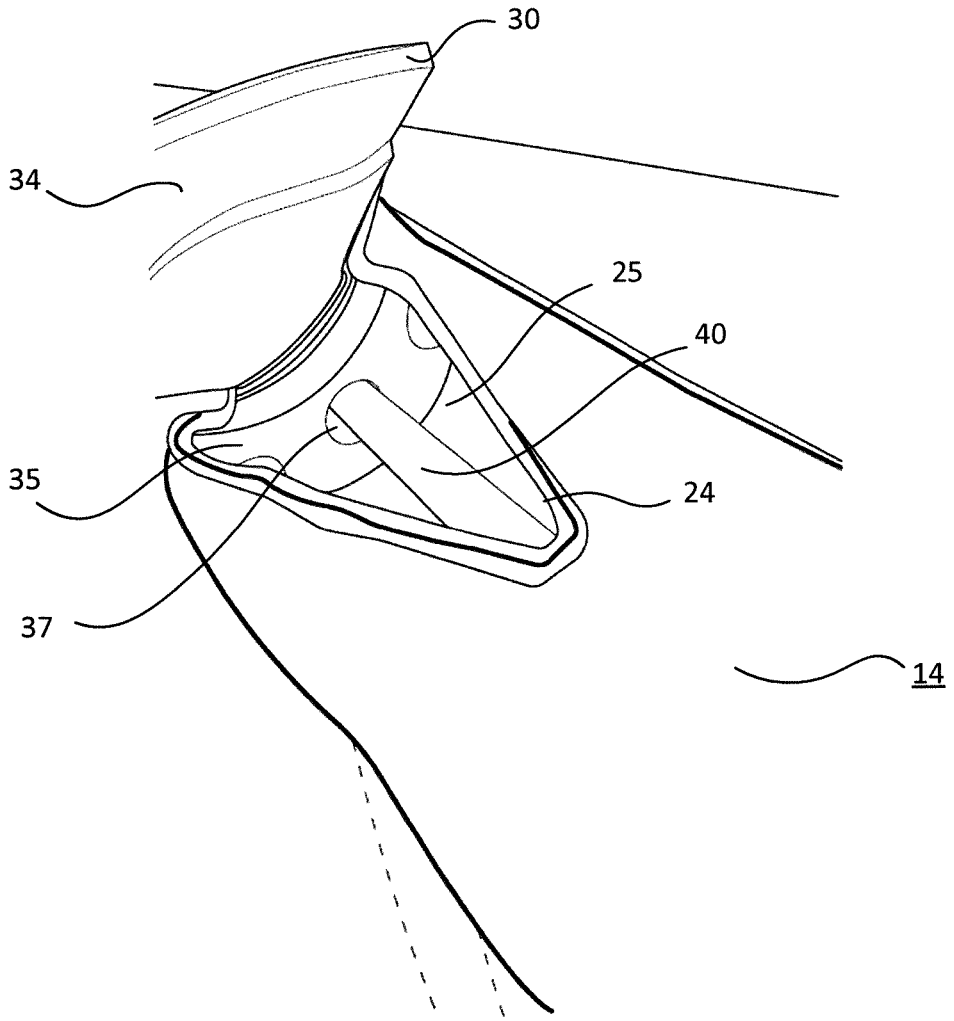
FIG. 10 is a close-up rear perspective view of an attachment cup installed on a support rail disposed in an interior compartment of the bath organizer, according to an exemplary embodiment of the present subject disclosure.

As shown in FIG. 10, the attachment cup 30 may extend from an opening 24 disposed in the left exterior surface 16 and/or the right exterior surface 19. The opening 24 may be disposed along the upper perimeter of the exterior surfaces 16,19, or at any other position on the left and right exterior surfaces 16,19. The opening 24 may be disposed at, or near to the left vertex 22 and/or the right vertex 23. Alternatively, the opening 24 may be disposed along, or on, the top left edge 62, the top right edge 63, or the back left and right edges 65,66. The opening 24 may have reinforced seams 73 in order to prevent the opening from tearing or ripping during use. The opening 24 may include a fastener for closing the opening 24. The fastener may be a zipper, buttons, hook and loop attachment, magnetic attachment, snap fit, and the like for securing the opening 24 in a closed position around the attachment cup 30. The opening 24 opens into an interior pocket 25 in which the attachment cup 30 attaches to the support rail 40 (See FIGS. 12-16). More than one opening 24 may be disposed on the bath organizer 10 for accessing the interior pocket 25 and facilitating the installation of additional attachment cups 30.

The interior pocket 25 may extend the length of the left panel 14, or a portion thereof. An additional interior pocket 25 may be similarly disposed in the right panel 17. Both the interior pocket 25 of the left panel 14 and the right panel 17 are adapted to receive a separate set of support rails 40. The interior pockets 25 of the left and right panels 14, 17 may be interrupted and separated by a reinforced seam 73 disposed at the apex 21 of the bath organizer 10. A reinforced seam 73 may define the bottom boundary of the interior pocket 25 (See FIGS. 3 and 8). Alternatively, a single interior pocket 25 may extend along the entire length of the left and right panels 14,17, without interruption by the seam 73 at the apex 21, in order to accommodate a single support rail assembly 40. Additional interior pockets 25 may be disposed on the bath organizer 10 for holding items, toys and the like.

Figure 11:
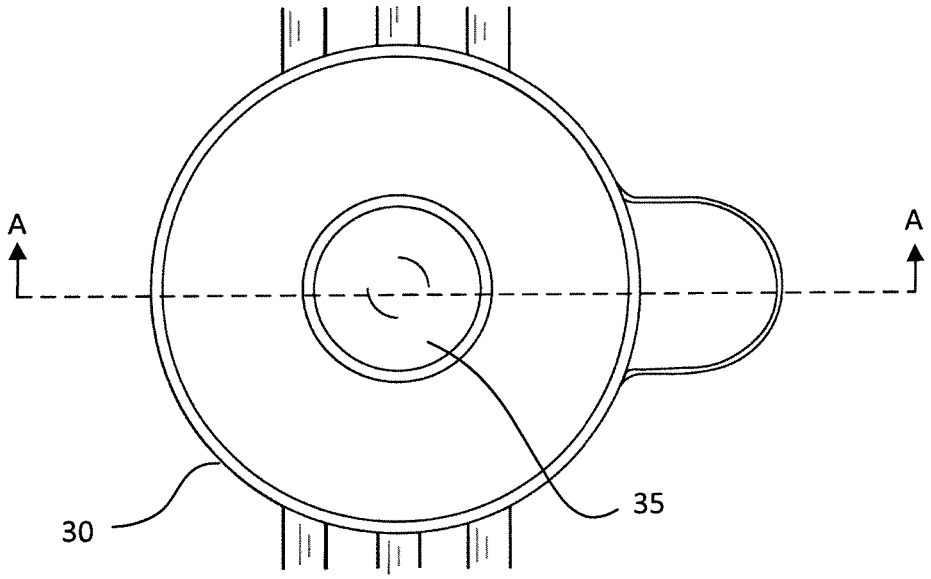
FIG. 11 is a top view of the attachment cup, according to an exemplary embodiment of the present subject disclosure.
Figure 11A:
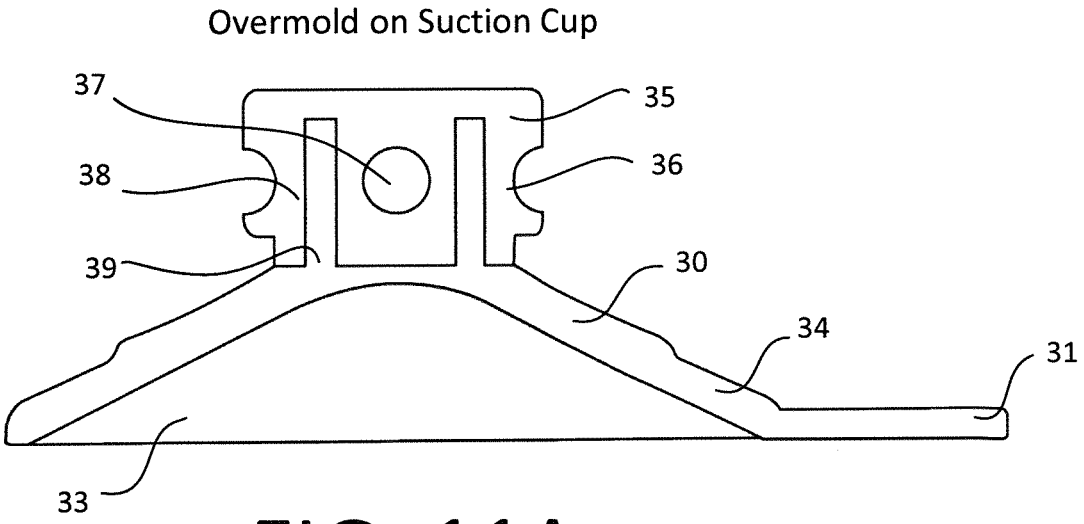
FIG. 11A is a cross section view of the attachment cup along plane A-A of FIG. 11, according to an exemplary embodiment of the present subject disclosure.

As shown in FIGS. 11-11A, the attachment cup 30 is fitted with a base 35. The base 35 may be permanently or removably affixed to the attachment cup 30. At least one protrusion 39 may extend from the outer portion 34 of the attachment cup 30. As shown in in FIG. 11, two protrusions 39 extend from the attachment cup 30. The protrusions 39 are received by receiving holes 38 disposed in the base 35. The receiving holes 38 and protrusions 39 may be threaded for a removable screwed attachment, or may attach through a friction fit, magnetic attachment, and/or the like. The attachment between the protrusions 39 and the receiving holes 38 may also be permanent through the use of an adhesive or through the manufacturing process. As shown in FIG. 11, the attachment cup 30 and the protrusions 39 are used as a substrate onto which the receiving holes 38 and base 35 are over-molded.

As shown in FIG. 11A, which is a cross-section about the plane A-A shown in FIG. 11, the base 35 has at least one groove 36 and at least one aperture 37 to receive and interact with the support rail assembly 40. The grooves 36 and aperture 37 may be formed in the base 35 during the manufacturing or molding process. The base aperture 37 may be disposed substantially along a center axis of the base 35, while the grooves 36 may be disposed along opposite sides of the peripheral portion of the base 35. Alternatively, the groove, or grooves 36 may be disposed along the center axis with or without the through aperture 37. One or more apertures 37 may be disposed on the peripheral portion of the base 35. The interaction between the base 35 of the attachment cup 30 and the support rail 40 is shown in greater detail in FIGS. 12-17.

FIG. 12 shows the base 35 installed on the support rail 40 with the support rail 40 in a flat and open position. When the support rail assembly 40 is in the open position, a user may install the base 35 of the attachment cup 30 onto the support rail 40. When installed, the base aperture 37 receives one of the support rails 40 therein, while additional support rails 40 engage the grooves 36. The base 35 and the attachment cup 30 are now able to translate along the length of the support rail assembly 40 to optimize the placement and attachment of the bath organizer 10 to the attachment surfaces 32. The ability to adjust the position of the base 35 and attachment cup 30 and cause it to travel along the support rail 40, enables the user to avoid potential obstacles that may interfere with the attachment of the bath organizer 10.

The support rail/support rail assembly 40 shown in FIG. 12 may be adapted to extend from the left panel 14, through the apex 23 and into the right panel 17. That is, the bath organizer 10 may be practiced with a single larger and longer support rail assembly 40. The support rail 40 shown in FIG. 12 may also be smaller and adapted for installation in a single panel. In this configuration, more than one support rail 40 may be installed in the panels. For example, one support rail 40 may be disposed in the left panel 14 and a second support rail may be installed in the right panel 17. The description that follows is applicable for both of these configurations.

As shown in FIG. 12, the support rail 40 includes three rails: a top rail 41, a middle rail 42 and a bottom rail 43, that may be substantially parallel along a first axis. A left end 51 and a right end 52 define the full length of the support rail 40 and the direction of the first axis. The rails of the support rail 40 may be substantially cylindrical, or rectangular, planar, and/or any other appropriate shape as long as it functions as described herein. The shape of the rails may be complementary to the grooves 36 and base aperture 37 of the base 35. At least one vertical rail 44 may connect to the other rails 41,42,43.

As shown in FIG. 12, the vertical rail 44 is disposed approximately at a midpoint 45 of the left and right ends 51, 52, and connects the top rail 41, middle rail 42 and bottom rail 43. The vertical rail 44 may have at least one hinge or vertical pivot 46 that may serve as a fulcrum for the opening of the top and bottom rails 41, 43. The middle rail 42 may also have a vertical pivot 46 or may remain stationary. Alternatively, the support rail 40 may be practiced without a vertical pivot 46 such that the support rail 40 is designed to bend enough vertically and horizontally to allow the attachment cups 30 to be installed and removed from the support rail 40.

The support rail 40 may be configured with at least one rail and may have different rail configurations, such as: two support rails, three support rails, four support rails, etc. The support rail 40 may be configured as a modular assembly with the ability to add additional rails and attachment cups 30. Different support rail 40 configurations are contemplated depending on the number of attachment cups 30 to be installed and the weight of the bath organizer 10 to be supported. In a single rail configuration, the base 35 may only include a single aperture 37 without the grooves 36 to accommodate the middle rail 42. Alternatively, in the single rail configuration, the base may only include grooves 36 without the aperture 37 to receive the rail. The shape of the base 35 may be flattened with a larger diameter in order to secure the attachment cup 30 in the interior pocket 25 with a single rail, or even without rails. In a dual rail system, two apertures 37 may be disposed on the base 35 to receive the top rail 41 and the bottom rail 43, or the base 35 may only include matching grooves 36 to accommodate the rails 41, 43.

As shown in FIG. 12, the vertical rail 44 may also have at least one horizontal hinge or pivot 46*a*. The horizontal pivot 46*a* may be a conventional hinge or joint formed in the vertical rail 44 that enables the support rail 40 to travel along a second axis orthogonal to the first axis. This allows the support rail 40 to fold (See FIG. 9) and promotes the installation of the bath organizer 10 on an uneven surface having bumps and potential obstacles. The support rails 40 may also be formed from a flexible, or soft material to attach around bumps and an uneven surface.

The horizontal pivot 46*a* may fit within the vertical rail 44 such that the substantially straight lines of the vertical rail 44 are not interrupted by the horizontal pivot 46*a*. The horizontal pivot 46*a* may have an outer sleeve engaging a central shaft and may fit substantially flush within any location disposed on the vertical rail 44. The horizontal pivot 46*a* may be adapted to allow the support rail 40 to flex within a range of 180 degrees so that the support rails 40 may transition from a straight position (FIG. 12) to a folded position (FIG. 9). This not only enables the bath organizer 10 to fold into a convenient storage position, but also facilitates attachment of the bath organizer 10 in corner junctions 2 that possess greater or less than right angles. Even in a relatively narrow space (walls 3 forming a corner junction 2 having an acute angle between them), the support rail 40 may fold along the horizontal pivot 46*a* in order to provide strong structural support for the attached bath organizer 10. Alternatively, the support rail 40 may be formed without the horizontal pivot 46*a* to promote a more rigid structure.

Figure 14:
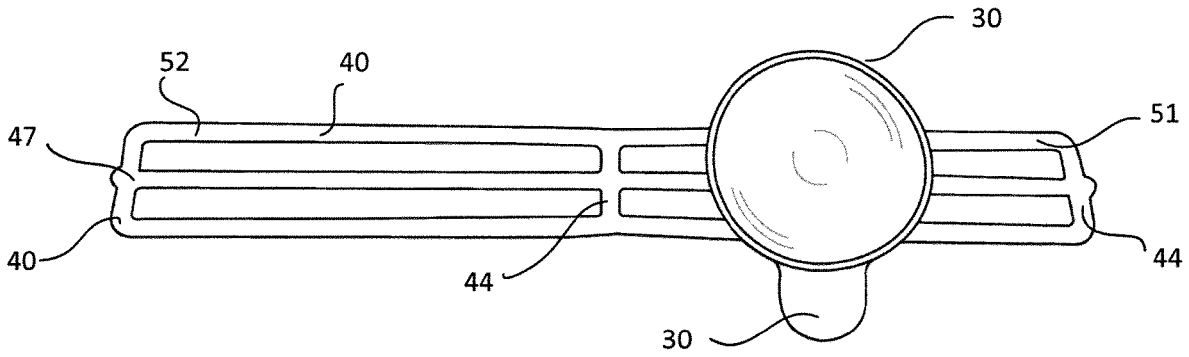
FIG. 14 is a rear view of the attachment cup installed on the closed support rail and removed from the interior compartment of the bath organizer, according to an exemplary embodiment of the present subject disclosure.

As shown in FIG. 12, the support rail 40 is shown in an open configuration. A locking mechanism 47 may be disposed at the left end 51 and/or the right end 52 to open and close the support rail 40 and secure the support rail 40 in a closed configuration (FIG. 14). As shown in FIG. 12, the locking mechanism 47 may consist of a locking post 48 disposed on the terminal ends of the middle rail 42, and complementary locking apertures 49 disposed on the terminal ends of the top rail 41 and bottom rail 43. The terminal ends of the top rail 41 and the bottom rail 43 curve downward and upward, respectively, in order to meet the complementary locking post 48 disposed on the terminal end of the middle rail 42. The locking apertures 49 may be disposed in an extended portion 50 that extends from the terminal ends of the top rail 41 and bottom rail 43. The extended portion 50 may have a thinner profile than the rest of the support rails 40. This ensures that the combined width of the locked locking mechanism 47 does not greatly exceed the diameter of the support rail 40. This keeps the support rail 40 substantially parallel and within the same plane as the vertical rail 44. This ensures a secure connection between the support rails 40, a flat profile, and ample structural support.

Figure 13:
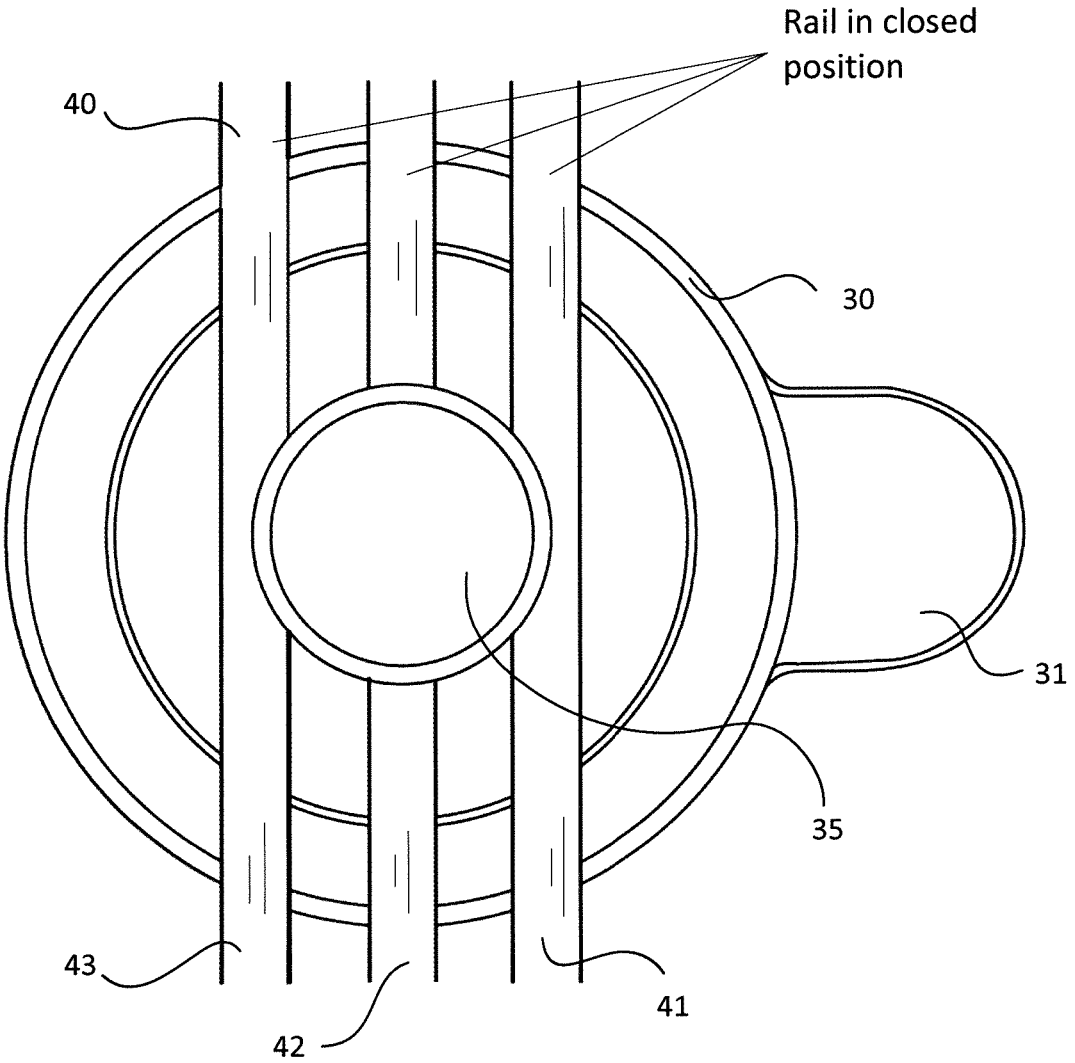
FIG. 13 is a close-up front view of the attachment cup installed on the support rail in a closed position, according to an exemplary embodiment of the present subject disclosure.

As shown in FIG. 13, when the support rail 40 is in the closed position, the top rail 41, the middle rail 42 and the bottom rail 43 may be substantially parallel to each other and may engage with the base 35 of the attachment cup 30. The top rail 41 and the bottom rail 43 may engage with the grooves 36, while the middle rail 42 may extend through the base aperture 37 (see also FIG. 17).

Figure 15:
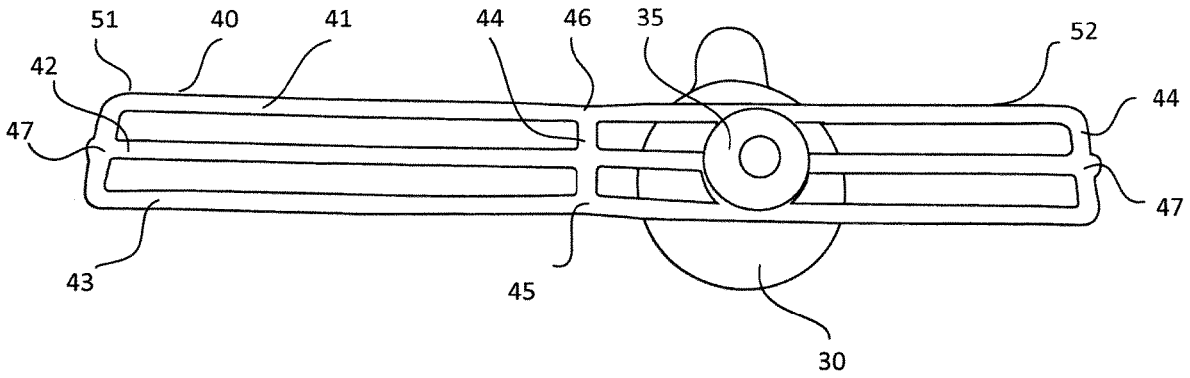
FIG. 15 is a front view of the attachment cup installed on the closed support rail and removed from the interior compartment of the bath organizer, according to an exemplary embodiment of the present subject disclosure.
Figure 16:
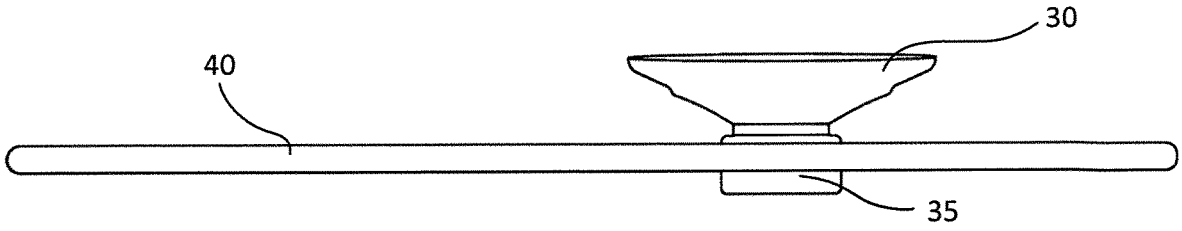
FIG. 16 is a side view of the attachment cup installed on the support rail in the closed position, according to an exemplary embodiment of the present subject disclosure.
Figure 17:
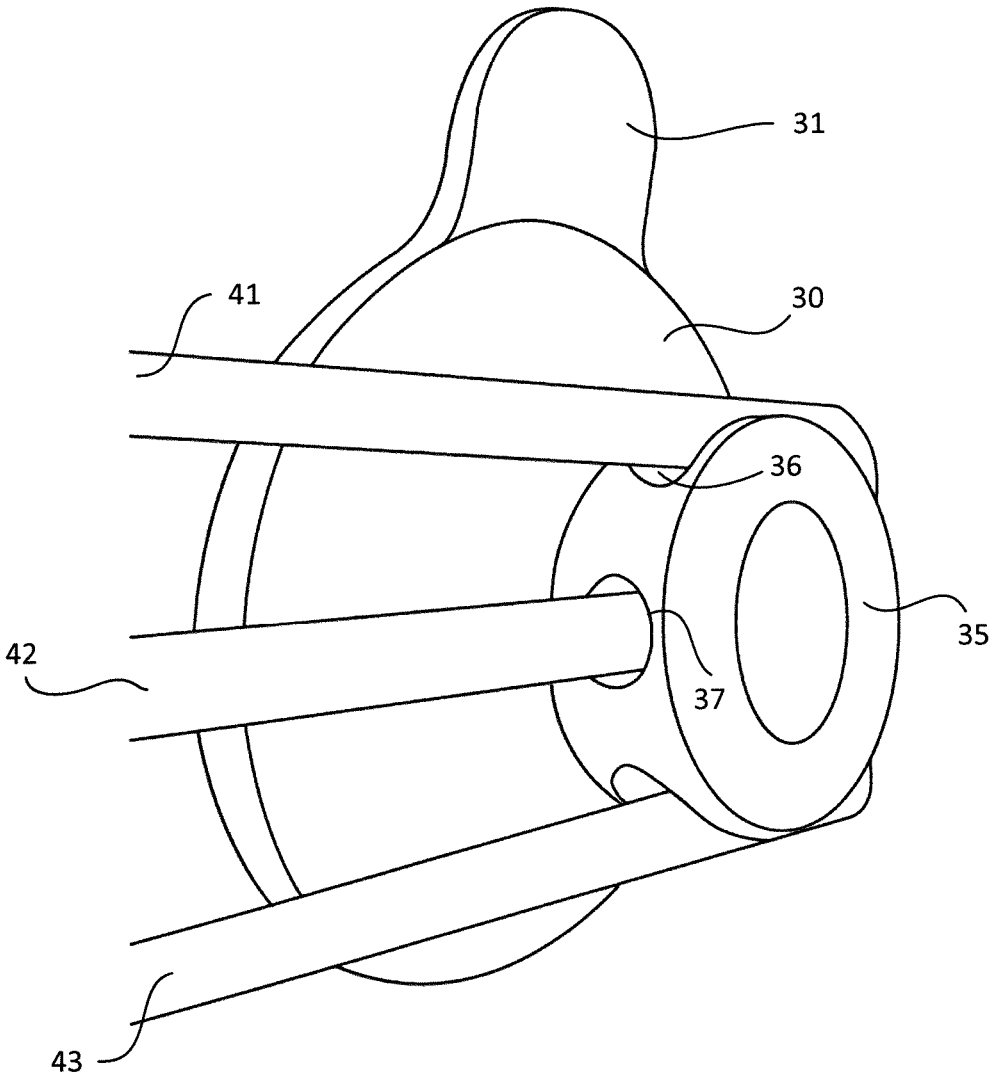
FIG. 17 is a close-up front perspective view of the attachment cup installed on the support rail in the closed position, according to an exemplary embodiment of the present subject disclosure.

FIGS. 14-16 show the attachment cup 30 installed on the support rail 40 in the closed configuration. In the closed configuration, the attachment cup 30 may slide or translate along the length of the support rail 40 until abutting against the vertical rail 44. This allows a user to position the attachment cup 30 at the desired location for attachment to the attachment surface 32. As shown in FIGS. 14-16, only a single attachment cup 30 is installed on the support rail 40. However, additional attachment cups 30 may be installed from either the left or right end 51, 52 of the support rail 40. In embodiments without the vertical rail 40, the support rails 40 may only require a single locking mechanism 47 disposed on either the left or right end 51, 52. The support rail 40 may include notches along the length of the rails to catch the base 35 to align with and indicate to the user the location of complementary openings 25 in the panels.

The support rail 40 shown in FIGS. 14-16 may not include the horizontal pivot 46*a* in the vertical rail 44. When not outfitted with the horizontal pivot 46*a*, the bath organizer 10 utilizes a first support rail 40 installed in the left panel 14 and a second support rail 40 installed in the right panel 17. This configuration, with the dual support rails 40 allows the bath organizer 10 to fold as shown in FIG. 9, while promoting structural integrity. The support rail or rails 40 may be removably installed in the bath organizer 10.

Figure 18:
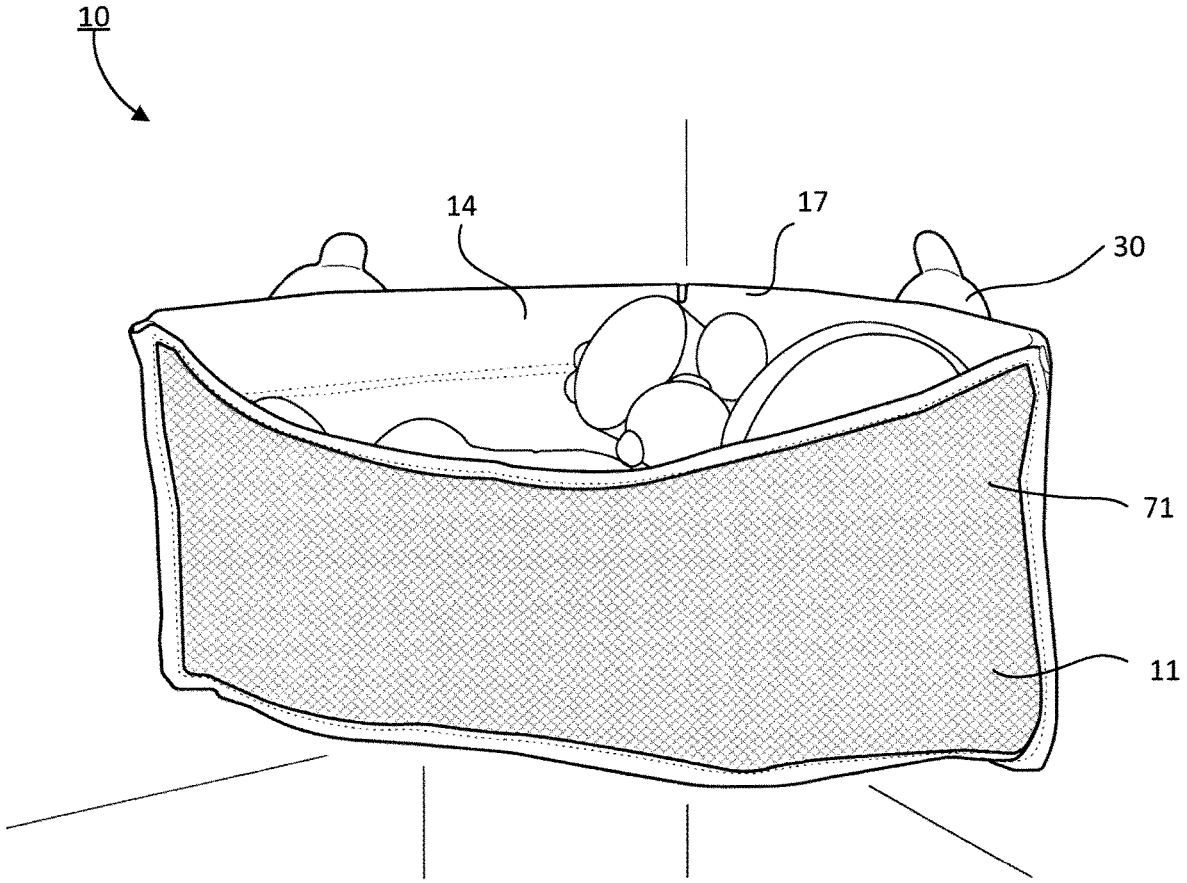
FIG. 18 is a front perspective view of the bath organizer with toys and other accessories, according to an exemplary embodiment of the present subject disclosure.
Figure 19:
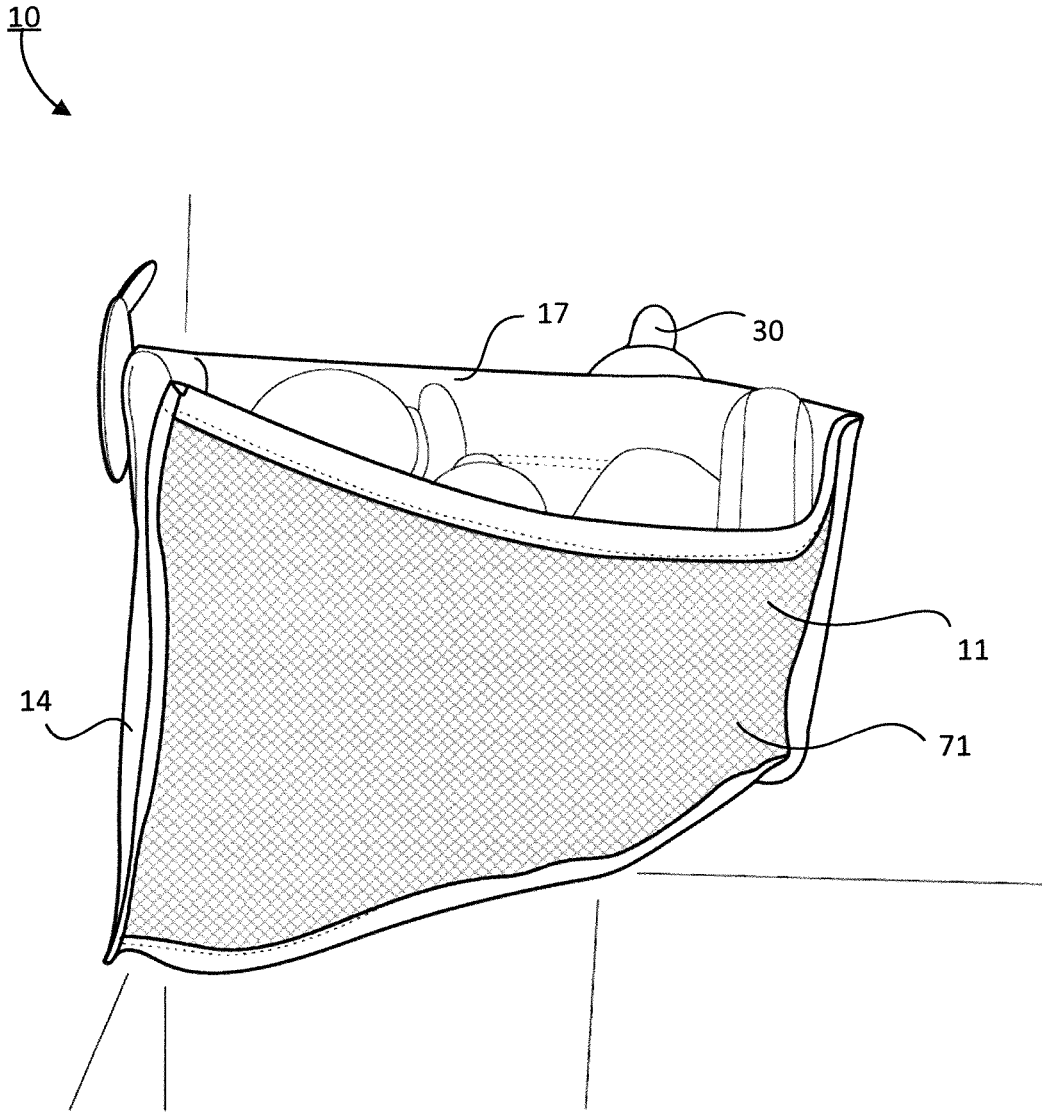
FIG. 19 is a side view of the bath organizer with bath toys and other accessories, according to an exemplary embodiment of the present subject disclosure.
Figure 20:
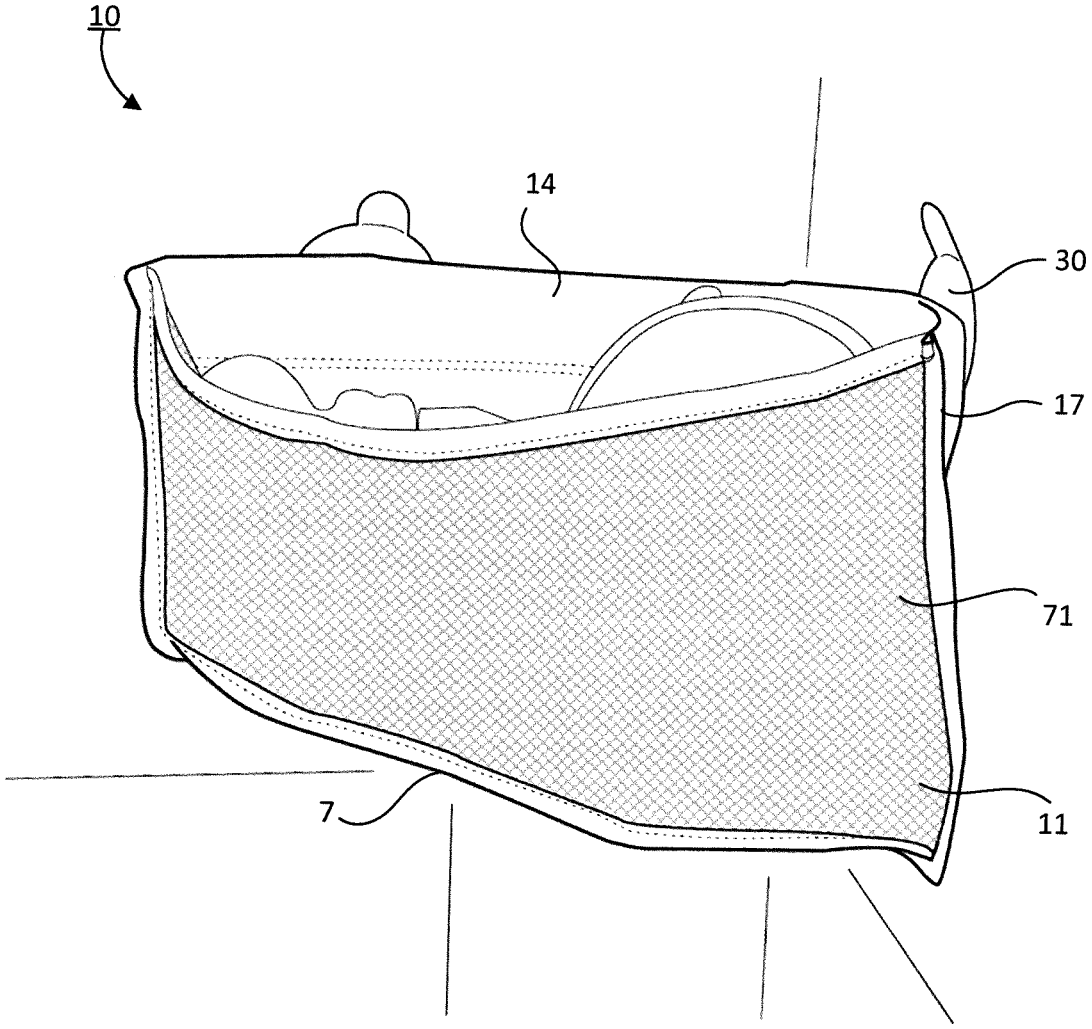
FIG. 20 is a side view of the bath organizer with bath toys and other accessories, according to an exemplary embodiment of the present subject disclosure.

FIGS. 18-20 are additional views of the bath organizer 10 in use. The bath organizer 10 may store toys, soap, towels and the like. The mesh 71 surfaces of the front panel 11 and bottom panel 7 allow wet items stored within to dry without the accumulation of mold or bacteria. The left and right panels 14, 17 may also be formed of the mesh 71 material. The attachment cups 30 provide a secure attachment to the attachment surfaces 32 in a wet environment. The bath organizer 10 is an efficient and aesthetically pleasing storage solution that improves the overall bathing experience for both children and adults alike.

As employed in this specification and annexed drawings, the term "or" is intended to mean an inclusive "or" rather than an exclusive "or." Moreover, articles "a" and "an" as used in the subject specification and annexed drawings should generally be construed to mean "one or more" unless specified otherwise or clear from context to be directed to a singular form.

What has been described above includes examples that provide advantages of the subject disclosure. It is, of course, not possible to describe every conceivable combination of components or methodologies for purposes of describing the subject disclosure, but one of ordinary skill in the art may recognize that many further combinations and permutations of the claimed subject matter are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiments described herein, but is intended to cover all modifications and changes within the scope and spirit of the invention.

What is claimed:

1. A bath organizer, comprising:
a front panel;
a left panel;
a right panel;
a bottom panel;
a support rail;
at least one attachment cup which is adapted to use suction to attach to a surface; and
a base secured to the attachment cup and having a through aperture for receiving the support rail, and a groove for engaging an adjacent parallel support rail.

2. The bath organizer of claim 1, wherein the support rail includes a top rail, a middle rail and a bottom rail that are substantially parallel.

3. The bath organizer of claim 1, further comprising an interior pocket disposed in at least one of the left or right panels.

4. The bath organizer of claim 3, wherein the support rail is disposed in the interior pocket.

5. The bath organizer of claim 1, wherein both the left panel and the right panel contain an interior pocket.

6. The bath organizer of claim 5, wherein the support rail is disposed in the interior pocket of the left panel and a second support rail is disposed in the interior pocket of the right panel.

7. The bath organizer of claim 1 wherein the base includes a first groove for receiving a top rail, a second groove for receiving a bottom rail and the through aperture for receiving a middle rail.

8. The bath organizer of claim 1 wherein the position of the base may be adjusted by sliding the base along the support rail.

9. The bath organizer of claim 1, further comprising a locking mechanism disposed on a first end or a second end of the support rail.

10. A bath organizer, comprising:
a storage compartment having at least one panel;
a support rail disposed in an interior pocket of the panel having at least a first rail;
an attachment cup which is adapted to use suction to attach to a surface; and
a base secured to the attachment cup and having a through aperture for receiving the first rail, and a groove for engaging an adjacent parallel support rail;
wherein the attachment cup is adapted to translate along the support rail.

11. The bath organizer of claim 10, wherein the storage compartment is triangular and has an interior volume defined by a left panel, a right panel, a front panel and a bottom panel.

12. The bath organizer of claim 10, wherein the support rail further comprises a second rail and a third rail substantially parallel with the first rail.

13. The bath organizer of claim 12, wherein the base has grooves to receive the second and third rails.

14. A bath organizer, comprising:

a storage compartment having an interior pocket;

a support rail assembly disposed within the interior pocket of the storage compartment; and at least one attachment cup adapted to use suction to attach to a surface; and a base secured to the attachment cup and having a through aperture for receiving the support rail, and a groove for engaging an adjacent parallel support rail;

wherein the attachment cup is adapted to translate along the support rail assembly.

15. The bath organizer of claim 14, further comprising a locking mechanism for transitioning the support rail assembly from an open position to a closed position.

16. The bath organizer of claim 15, wherein the support rail assembly includes a top rail, a middle rail and a bottom rail which are substantially parallel with each other.

17. The bath organizer of claim 16, further comprising at least one hinge disposed on a vertical post located at a midpoint of the support rail assembly for pivoting the support rail assembly from the open position to the closed position.

* * * * *